United States Patent [19]

Carmi et al.

[11] Patent Number: 5,060,479

[45] Date of Patent: Oct. 29, 1991

[54] THERMOELECTRIC DEVICE FOR HEATING OR COOLING FOOD AND DRINK CONTAINERS

[75] Inventors: Amatzia Carmi, Kibbutz Afikim; Abraam Ram, Pardes Hana; Izac Gur-Arif, Kibbutz Afikim, all of Israel

[73] Assignee: Afikim Kvutzat Poalim Lehity Ashvut Shitufit B.M., Kibbutz Afikim, Israel

[21] Appl. No.: 607,303

[22] Filed: Oct. 31, 1990

[30] Foreign Application Priority Data

Nov. 3, 1989 [IL] Israel ..... 92209

[51] Int. Cl.[5] ..... F25B 21/02

[52] U.S. Cl. ..... 62/362; 62/457.4

[58] Field of Search ..... 62/3.64, 3.3, 3.62, 62/3.2, 457.1, 457.3, 457.4, 457.8, 457.9, 239, 244, 324.2

[56] References Cited

U.S. PATENT DOCUMENTS 3,445,039 5/1969 Brodsky et al. ..... 62/3.64

4,823,554 4/1989 Trachtenberg et al. ..... 62/3.3

*Primary Examiner*—Albert J. Makay

*Assistant Examiner*—John Solleitto

*Attorney, Agent, or Firm*—Helfgott & Karas

[57] ABSTRACT

A thermoelectric apparatus for heating or cooling food and drink containers. The apparatus has at least one compartment for holding a container that is to be heated or cooled and in association therewith a thermoelectric device in intimate contact on the one hand with a concave holder for the container that is being heated or cooled and on the other hand with a heat exchanger having radiator and blower sections. The apparatus is powered by low voltage DC and is suitable for use in motor vehicles.

6 Claims, 3 Drawing Sheets

THERMOELECTRIC DEVICE FOR HEATING OR COOLING FOOD AND DRINK CONTAINERS

FIELD OF THE INVENTION

The present invention is in the field of thermoelectric heat pumping and concerns thermoelectric apparatus for heating or cooling food and drink containers. More particularly, the present invention relates to effective heat pumping devices particularly useful for heating or cooling food and drink containers in locations where conventional cooking and refrigerating apparatus are unavailable, e.g. in motor vehicles, offices, hotel rooms and the like.

BACKGROUND OF THE INVENTION AND PRIOR ART

Thermoelectric devices consist of a plurality of n- and p-type semiconductor elements arranged in a series of so-called thermocouples, each of which is linked at both ends to a counterpart by conductor junctions. Thus such a device has two sides each having a plurality of junctions each linking two members of a thermocouple and when a temperature gradient is formed between these two sides by heating and/or cooling, electric power is generated. If, on the other hand, current is flown through the device so as to flow in series through all thermocouples thereof, one side is heated and the other side is cooled and the device functions as a heat pump.

The effectivity of known thermoelectric heat pumps is low and any heating and cooling occurs very slowly. Consequently such devices are, in practice, employed mainly for maintaining an object such as a beverage or food container at a desired, previously established temperature and not so much for lowering or raising the temperature thereof to any significant extent.

It is the object of the present invention to provide an effective thermoelectric heat pump for cooling or heating beverage or food containers, operable by low voltage electric energy and capable of quick heating and cooling.

GENERAL DESCRIPTION OF THE INVENTION

In accordance with the present invention there is provided a thermoelectric apparatus for heating or cooling food and drink containers comprising a housing of a heat insulating material with at least one compartment for holding a container; a heat transfer member of low heat storage capacity with a concave front side and a back side, which front side is adapted to establish intimate contact with a container in said at least one compartment; a thermoelectric device connectable to a source of direct electric current via switch means for selecting the direction of current flow and having a first face bearing on the back side of the heat transfer member and an opposite, second face; a heat exchanger comprising a radiator section and adapted for intimate contact with the second face of the thermoelectric device, and a blower section holding a blower adapted to pump ambient air through the radiator section; and means for tightening together a container placed within said at least one compartment and said heat conductor member, so as to cause intimate contact between them.

The heat transfer member is preferably of aluminum.

The radiator section preferably comprises a base plate connected to the thermoelectric element and a plurality of prongs projecting therefrom towards said blower section.

An apparatus according to the invention may be designed for use in a motor vehicle. In such a case the apparatus comprises an electric cord adapted for plugging into the electric lighter socket normally near the driver's seat. An apparatus for use in a motor vehicle will, as a rule, have only one or two compartments for holding a container so as not to impose a too heavy load on the vehicle's electric power supply.

If desired an apparatus according to the invention may be held by a specially designed holder or clamp. This may be particularly useful when the apparatus is designed for use in a motor vehicle.

With an apparatus according to the invention using a 12 V DC source such as a battery or a transformer-rectifier, a container holding food or beverage at ambient temperature of say 30° C. may be heated at a rate of about 3° C./min. and cooled at a rate of about 1° C./min. This cooling rate is quite remarkable and is about threefold that of an ordinary freezer.

BRIEF DESCRIPTION OF THE DRAWINGS

For better understanding of the present invention a specific embodiment will now be described with reference to the annexed drawings, it being understood that the invention is not limited thereto.

In the drawings.

DETAILED DESCRIPTION OF THE INVENTION

Figure 1:
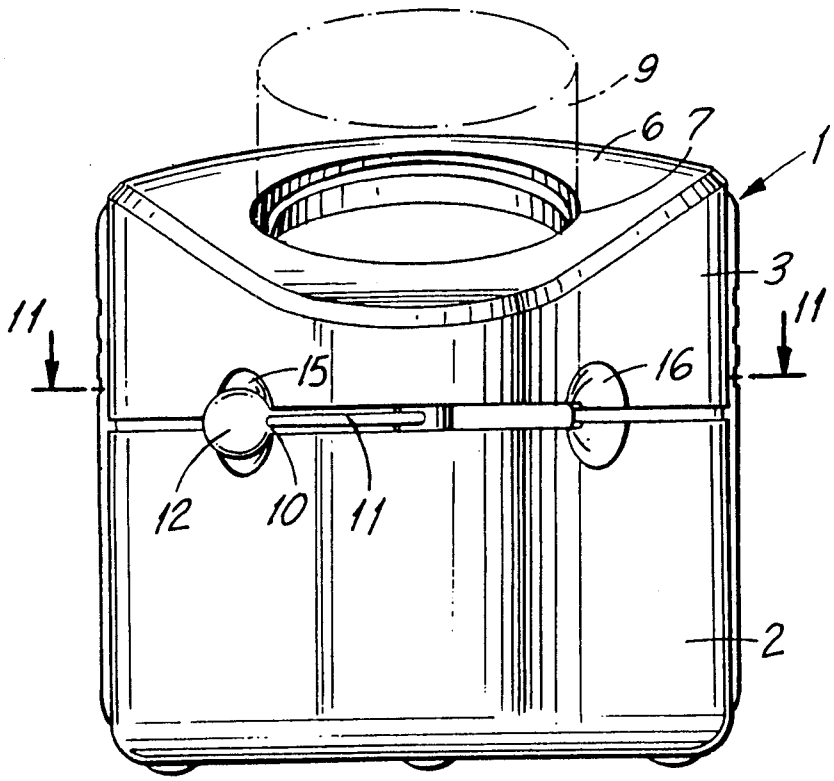
FIG. 1 is a front perspective view of a thermoelectric apparatus according to the invention.

The embodiment of the thermoelectric apparatus of the invention shown in FIG. 1 comprises a housing 1 with a lower front section 2, an upper front section 3, an upper rear section 4 and a lower rear section 5. The housing further comprises top wall 6 with an opening 7 providing access to a compartment 8 for the insertion of a container 9.

Figure 4:
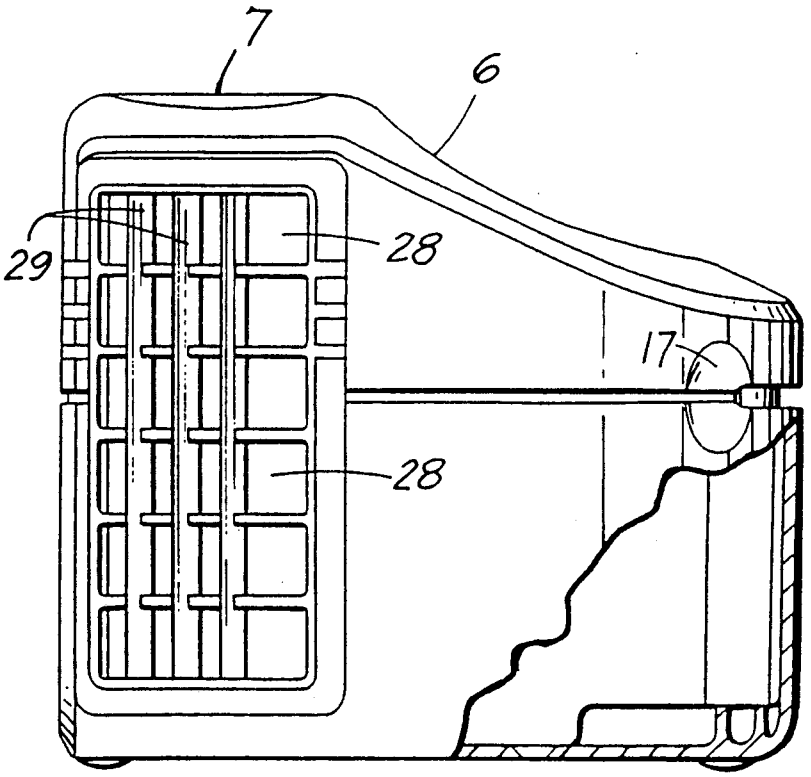
FIGS. 3 and 4 are two opposite side views of the apparatus of FIG. 1.
Figure 3:
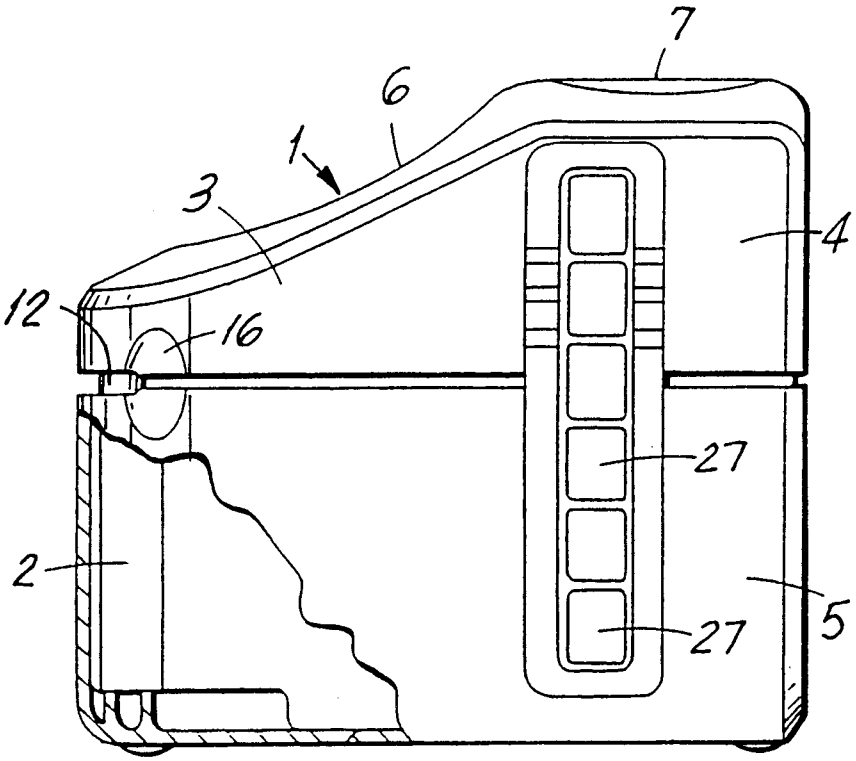

A shown in FIGS. 3 and 4, top wall 6 is inclined, sloping between front and rear upper sections 3 and 4. This inclined construction of top wall 6 ensures that container 9 is readily accessible from the outside for its extraction from compartment 8.

The front section of housing 2 comprises an eccentric type tightening means 10 for tightening container 9 to the heat pump section of the apparatus. The tightening means comprises a handle 11 fitted with a knob 12 and comprising a hub 13, eccentrically hinged on an axle 14. By swinging handle 11 from one side to the other, container 9 is tightened or released. In the extreme positions of the tightening means 10, knob 12 thereof is located in either of recesses 15 and 16. Due to the design of tightening means 10 containers of different sizes may be held tightly within compartment 8.

Figure 2:
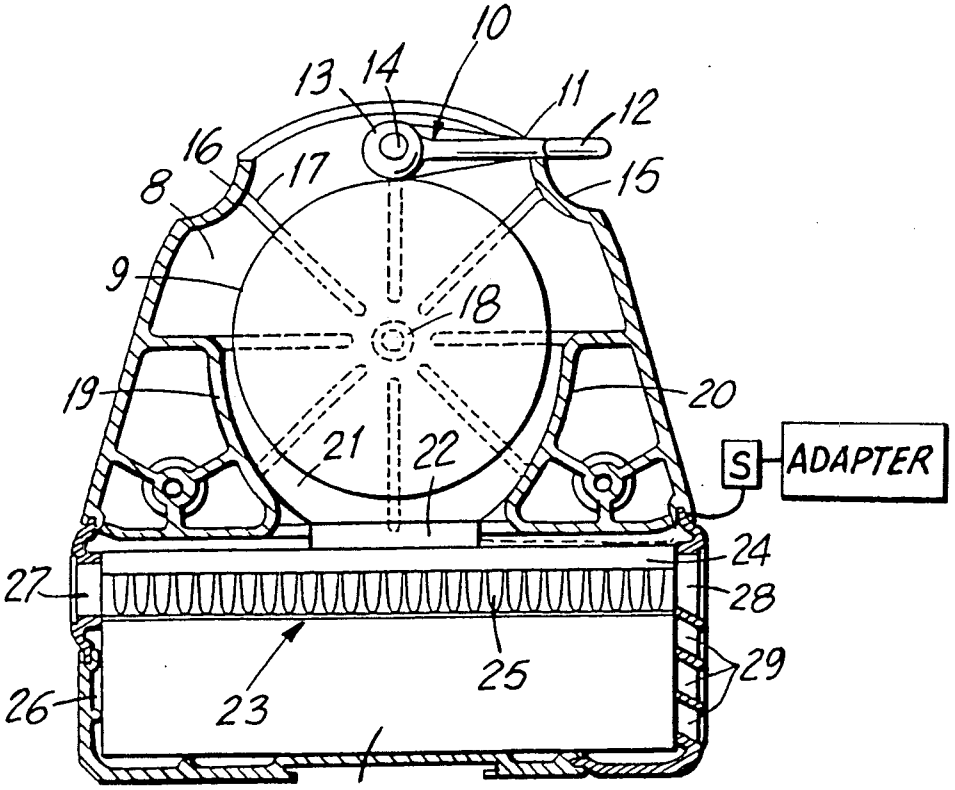
FIG. 2 is a a cross-section along lines II—II of FIG. 1.

As further shown in FIG. 2 the bottom of compartment 8 is fitted with a plurality of radial ribs 17 and a central, frustoconical boss 18 for supporting container 9 so as to keep it at a distance from the bottom of compartment 8 in order to avoid excessive heat losses.

Within compartment 8 there are provided concave partitions 19 and 20 spaced from each other in the manner shown and serving as supports for a concave heat transfer member 21 adapted in operation for intimate contact with container 9 and to envelope about half the circumference thereof. This intimate contact occurs when tightening means 10 is in a tightening position. Partitions 19 and 20 are made integral with the exterior wall of housing 1 with the interposition of reinforcing ribs in the manner shown.

Figure 5:
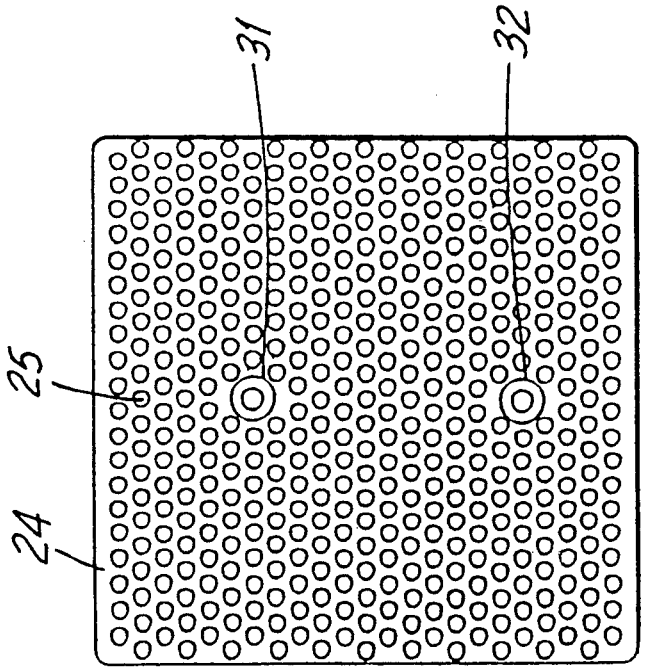
FIG. 5 is a top view of a radiator forming part of a heat exchanger in apparatus of FIGS. 1 to 4 with the conical prongs being shown by way of single circles.
Figure 6:
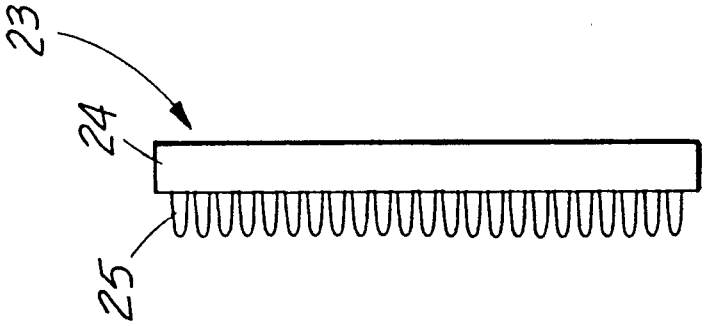
FIG. 6 is a side view of the radiator of FIG. 5.

The opening between partitions 19 and 20 provides access to the heat pump section of the apparatus which comprises a thermoelectric device 22 attached on its one side to heat transfer member 21 and on its other side bearing on the base plate 24 of a heat exchanger 23 having a plurality of prongs 25. Heat exchanger 23 is securely mounted within a compartment 26 and is attached by fasteners 31, 32 (FIG. 5) to the thermoelectric device 22.

On its two sides chamber 26 comprises a plurality of air ingress openings 27 and 28 and a plurality of air eggress slots 29 adjoining the latter.

Located within chamber 26 and in proximity to heat exchanger 23 is a blower 30 having an aspiration opening (not shown) facing prongs 25 and an exhaust opening (equally not shown) facing slots 29. The axes of the aspiration and exhaust openings are thus normal to each other.

The thermoelectric device 22 and the blower 30 are each connectable to a DC source. The thermoelectric device is connected to the DC source via switch means S for selecting the direction of current flow therethrough.

In operation a container 9 is inserted into compartment 8 and is tightened by positioning tightening means 10 in the tightening state whereby the container is brought in intimate contact with the heat transfer member 21. Assuming that the container 9 has to be cooled, the direction of current flow is so selected that the front face of thermoelectric device 22 which is connected to the heat transfer member 21 is the cold side while the opposite, rear face is the hot side. Blower 30 is put in operation whereby air is aspired via ingress opening 27, 28 to flow turbulently through the spaces between prongs 25 and the so-aspired air is blown out via slot 29. In consequence of this turbulent and intensive air flow, heat is dissipated from the thermoelectric device 22 and in this way the container 9 is cooled.

When it is desired to heat the container 9 the electric current flow through the thermoelectric device 22 is reversed while the operation of blower 30 remains the same. In this case heat is constantly supplied to the thermoelectric device 22 whereby container 9 is heated.

When an apparatus according to the invention comprises two or more container holding compartments each of these may be similarly designed as the single chamber in the above described single-chamber apparatus and each be associated with a heat pump section. In such an apparatus the thermoelectric devices may be connected in parallel or in series.

We claim:

1. A thermostatic apparatus for heating or cooling of a substantially cylindrical container for food and drink, the apparatus comprising a housing made of a heat insulating material and having at least one compartment; a heat transfer member of low heat storage capacity positioned remote from an outer wall of said at least one compartment and having a concave side facing said compartment and an opposite side having a flat portion of an area smaller than that of the concave side, said concave side facing said compartment being constructed to envelope part of a circumference of said container in an inserted position thereof; a thermoelectric device matching the flat portion of said opposite side of the heat transfer member and being connectable to a source of direct electric current via switch means for selecting a direction of current flow, said thermoelectric device having a first face bearing on the flat portion of the opposite side of the heat transfer member and an opposite, second face; a heat exchanger including a radiator section and mounted in intimate contact with the second face of said thermoelectric device, and a blower section holding a blower adapted to pump ambient air through said radiator section; and means for tightening together a container placed within said at least one compartment and said heat transfer member so as to cause intimate contact therebetween whereby said heat transfer member and said tightening means coact to define means to enable the heat transfer member to establish intimate contact with about a half of a side wall of said container for removably receiving and holding said container.

2. An apparatus according to claim 1 wherein said radiator section comprises a base plate connected to the thermoelectric device and a plurality of prongs projecting therefrom towards said blower section.

3. An apparatus according to claim 1 wherein said heat transfer member is of aluminum.

4. An apparatus according to claim 1 designed for use in a motor vehicle and comprising an electric cord adapted for plugging into an electric lighter socket normally near the driver's seat.

5. An apparatus according to claim 2, wherein said heat transfer member is of aluminum.

6. An apparatus according to claim 2 designed for use in a motor vehicle and comprising an electric cord adapted for plugging into an electric lighter socket normally near the driver's seat.

* * * * *